US006729283B2

(12) United States Patent
Simpson et al.

(10) Patent No.: US 6,729,283 B2
(45) Date of Patent: May 4, 2004

(54) EXTERNALLY MOUNTED VACUUM CONTROLLED ACTUATOR WITH POSITION SENSOR CONTROL MEANS TO REDUCE FUNCTIONAL AND MAGNETIC HYSTERESIS

(75) Inventors: Roger Simpson, Ithaca, NY (US); Braman Wing, Interlaken, NY (US)

(73) Assignee: BorgWarner Inc., Auburn Hills, MI (US)

( * ) Notice: Subject to any disclaimer, the term of this patent is extended or adjusted under 35 U.S.C. 154(b) by 5 days.

(21) Appl. No.: 10/281,736

(22) Filed: Oct. 28, 2002

(65) Prior Publication Data

US 2003/0196617 A1 Oct. 23, 2003

Related U.S. Application Data

(60) Provisional application No. 60/374,600, filed on Apr. 22, 2002.

(51) Int. Cl.[7] ..... F01L 1/34

(52) U.S. Cl. ..... 123/90.17; 74/568 R; 123/90.15; 123/90.31

(58) Field of Search ..... 123/90.15, 90.16, 123/90.17, 90.12, 90.31; 74/568 R; 464/1, 2, 160; 91/365, 378

(56) References Cited

U.S. PATENT DOCUMENTS

| | | | | |
|---|---|---|---|---|
| 4,627,825 A | | 12/1986 | Bruss et al. | 464/2 |
| 5,002,023 A | | 3/1991 | Butterfield et al. | 123/90.15 |
| 5,107,804 A | | 4/1992 | Becker et al. | 123/90.17 |
| 5,172,659 A | | 12/1992 | Butterfield et al. | 123/90.17 |
| 5,184,578 A | | 2/1993 | Quinn, Jr. et al. | 123/90.17 |
| 5,361,735 A | | 11/1994 | Butterfield et al. | 123/90.17 |
| 5,497,738 A | | 3/1996 | Siemon et al. | 123/90.17 |
| 2002/0002824 A1 | * | 1/2002 | Hirota et al. | 60/297 |
| 2003/0062010 A1 | * | 4/2003 | Diggs et al. | 123/90.17 |

* cited by examiner

*Primary Examiner*—Thomas Denion
*Assistant Examiner*—Jaime Corrigan
(74) *Attorney, Agent, or Firm*—Brown & Michaels, PC; Greg Dziegielewski

(57) ABSTRACT

The present invention controls the position of a center mounted spool valve (192) with an externally mounted vacuum controlled actuator (301). The actuator position is preferably controlled by a pulse width modulated or variable force solenoid (302), which modulates the amount of vacuum going to the actuator (301). A microprocessor (208) reads the phase angle and adjusts the duty cycle or current based on the error signal of the control loop (450). In a preferred embodiment, a position sensor (304) further controls the position of the spool valve (192). The position sensor (304) creates an inner loop (400) with position feedback on the position of the actuator (301) and spool valve (192), while the outer loop controls the phase angle. Added to the spool valve position is an offset to move the spool valve (192) to its steady state or null position (410).

22 Claims, 4 Drawing Sheets

EXTERNALLY MOUNTED VACUUM CONTROLLED ACTUATOR WITH POSITION SENSOR CONTROL MEANS TO REDUCE FUNCTIONAL AND MAGNETIC HYSTERESIS

REFERENCE TO RELATED APPLICATIONS

This application claims an invention which was disclosed in Provisional Application No. 60/374,600, filed Apr. 22, 2002, entitled "EXTERNALLY MOUNTED VACUUM CONTROLLED ACTUATOR WITH POSITION SENSOR CONTROL MEANS TO REDUCE FUNCTIONAL AND MAGNETIC HYSTERESIS". The benefit under 35 USC §119(e) of the United States provisional application is hereby claimed, and the aforementioned application is hereby incorporated herein by reference.

BACKGROUND OF THE INVENTION

1. Field of the Invention

The invention relates to a hydraulic control system for controlling the operation of a variable camshaft timing (VCT) system. More particularly, the invention pertains to the use of an externally mounted vacuum controlled actuator to control the position of a center mounted spool valve.

2. Description of Related Art

U.S. Pat. No. 4,627,825 uses a pneumatic actuator to operate an external spool valve which supplies oil to the cylinders of a phaser. Phaser position is fed back via sensors on cam and crankshafts.

Consideration of information disclosed by the following U.S. patents, which are all hereby incorporated by reference, is useful when exploring the background of the present invention.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position of a camshaft relative to a crankshaft. The control system utilizes a control valve in which the exhaustion of fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from a hydraulic cylinder or other force multiplier which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

In U.S. Pat. No. 5,361,735, a camshaft has a vane secured to an end for non-oscillating rotation. The camshaft also carries a timing belt driven pulley which can rotate with the camshaft but which is oscillatable with respect to the camshaft. The vane has opposed lobes which are received in opposed recesses, respectively, of the pulley. The camshaft tends to change in reaction to torque pulses which it experiences during its normal operation and it is permitted to advance or retard by selectively blocking or permitting the flow of engine oil from the recesses by controlling the position of a spool within a valve body of a control valve in response to a signal from an engine control unit. The spool is urged in a given direction by rotary linear motion translating means which is rotated by an electric motor, preferably of the stepper motor type.

U.S. Pat. No. 5,497,738 uses a variable force solenoid to control the phase angle using a center mounted spool valve. This type of variable force solenoid can infinitely control the position of the phaser. The control system eliminates the hydraulic force on one end of a spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

None of the prior art uses vacuum actuators to move a centrally-mounted spool valve, or provides position sensors on vacuum actuators for phasers.

SUMMARY OF THE INVENTION

The present invention controls the position of a center mounted spool valve with an externally mounted vacuum controlled actuator. The actuator position is preferably controlled by a pulse width modulated or variable force solenoid to control the amount of vacuum going to the actuator. A microprocessor reads the phase angle and adjusts the duty cycle or current based on the error signal of the control loop. One method to control the position of the actuator maps the position of the actuator versus command signal. Since these types of actuators have certain manufacturing tolerances, the position of the actuator could be off as much as 10% of full travel. Therefore, a preferred embodiment also includes a position sensor to further control the position of the spool valve. The position sensor creates an inner loop with position feedback on the position of the actuator and spool valve. The outer loop controls the phase angle. Added to the spool valve position is an offset to move the spool valve to its steady state or null position. This null position is required so that the spool can move in to move the phaser in one direction and outward to move the phaser in the other direction.

DETAILED DESCRIPTION OF THE INVENTION

The present invention controls the position of a center mounted spool valve, which controls the oil flow to and from the chambers of a vane or piston-style cam phaser, using an externally mounted vacuum controlled actuator. The "phaser" is all of the parts of the engine which allow the camshaft to run independently of the crankshaft. The actuator position is preferably controlled by a pulse width modulated or variable force solenoid to control the amount of vacuum going to the actuator. The solenoid is preferably located in a vacuum control valve. However, the solenoid or other vacuum control may also be located within the actuator itself. A microprocessor reads the phase angle and adjusts the duty cycle or current based on the error signal of the control loop. The microprocessor is preferably an engine control unit ("ECU") which monitors various engine parameters. The ECU receives signals from sensors corresponding to camshaft and crankshaft positions and utilizes this information to calculate a relative phase angle. A closed-loop feedback system which corrects for any phase angle error is preferably employed. This method controls the position of the actuator and maps the position of the actuator versus command signal (duty cycle or current).

These types of actuators have certain manufacturing tolerances which often result in the position of the actuator being off as much as 10% of full travel. Although the integrator in the control loop compensates for this error, a more robust control system of the present invention has an inner loop that includes position feedback on the position of the actuator and spool valve. The present invention reduces the error created by the prior art by having a position sensor mounted to an actuator rod, or spool valve position, of the vacuum controlled actuator. A feedback control loop controls the position of the spool valve. This method reduces any frictional or magnetic hysteresis in the spool and actuator control system. There is also preferably a second, outer feedback loop to control the phaser angle. An offset is preferably added to the spool valve position to move the spool valve to its steady state or null position. The null position is required so that the spool can move in to move the phaser in one direction and move out to move the phaser in the other direction.

Figure 1:
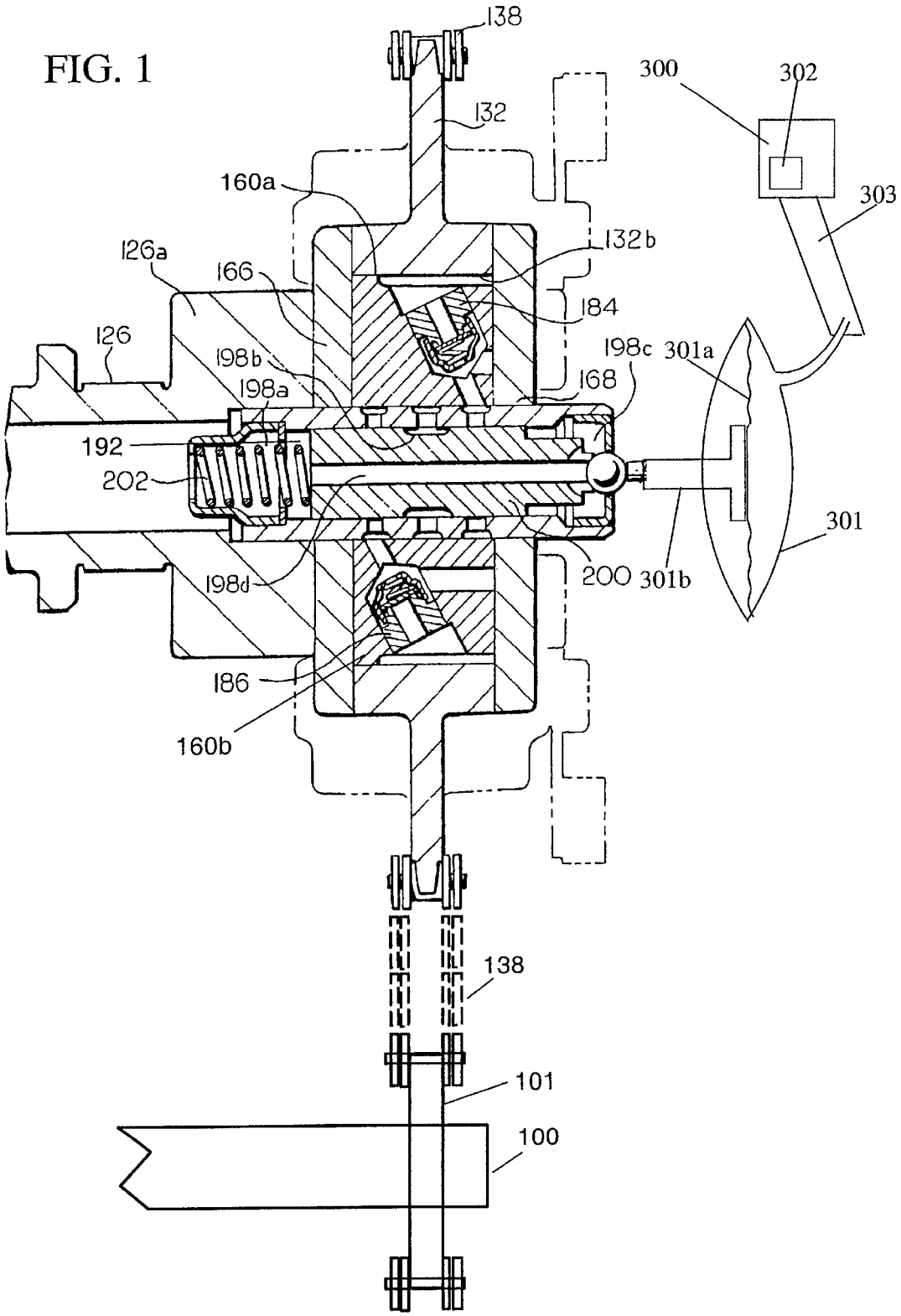
FIG. 1 is a sectional view of a cam phaser with an externally mounted vacuum controlled actuator of the invention.

FIG. 1 shows a cam phaser of the present invention in which a housing in the form of a sprocket (132) is oscillatingly journalled on a camshaft (126). The camshaft (126) may be considered to be the only camshaft of a single camshaft engine, either of the overhead camshaft type or the in block camshaft type. Alternatively, the camshaft (126) may be considered to be either the intake valve operating camshaft or the exhaust valve operating camshaft of a dual camshaft engine. In any case, the sprocket (132) and the camshaft (126) are rotatable together, and are caused to rotate by the application of torque to the sprocket (132) by an endless roller chain (138), shown fragmentarily, which is trained around the sprocket 132 and also around a crankshaft (100) with its own sprocket (101). The sprocket (132) is oscillatingly journalled on the camshaft (126) so that it is oscillatable at least through a limited arc with respect to the camshaft (126) during the rotation of the camshaft, an action which will adjust the phase of the camshaft (126) relative to the crankshaft (100).

An annular pumping vane is fixedly positioned on the camshaft (126), the vane having a diametrically opposed pair of radially outwardly projecting lobes **(160*a*), (160*b*) and being attached to an enlarged end portion (126*a*) of the camshaft (126) by bolts which pass through the vane (160) into the end portion (126*a*). The lobes (160*a*), (160*b*) are received in radially outwardly projecting recesses (132*a*), (132*b*), respectively, of the sprocket (132), the circumferential extent of each of the recesses (132*a*), (132*b*) being somewhat greater than the circumferential extent of the vane lobe (160*a*), (160*b*) which is received in such recess to permit limited oscillating movement of the sprocket (132) relative to the vane (160). The recesses (132*a*), (132*b*) are closed around the lobes (160*a*), (160*b*), respectively, by spaced apart, transversely extending annular plates (166), (168) which are fixed relative to the vane (160), and, thus, relative to the camshaft (126), by bolts which extend from one to the other through the same lobe, (160*a*), (160*b*)**.

Spool valve (192) is made up of cylindrical member (198) and vented spool (200) which is slidable to and fro within cavity **(198*a*), as is schematically shown in FIG. 1, where camshaft (126) is being maintained in a selected intermediate position relative to the crankshaft of the associated engine, referred to as the "null" position of spool (200)**.

Hydraulic fluid, illustratively in the form of engine lubricating oil, flows into the recesses **(132*a*), (132*b*) from the spool valve (192) by way of a common inlet line, terminating at a juncture between opposed check valves (184) and (186) which are connected to recesses (132*a*), (132*b*)**.

In the present invention, the position of vented spool (200) within member (198) is influenced by spring (202) which acts on the end of the spool (200). Thus, spring (202) resiliently urges spool (200) to the right, as oriented in FIG. 1.

Figure 2:
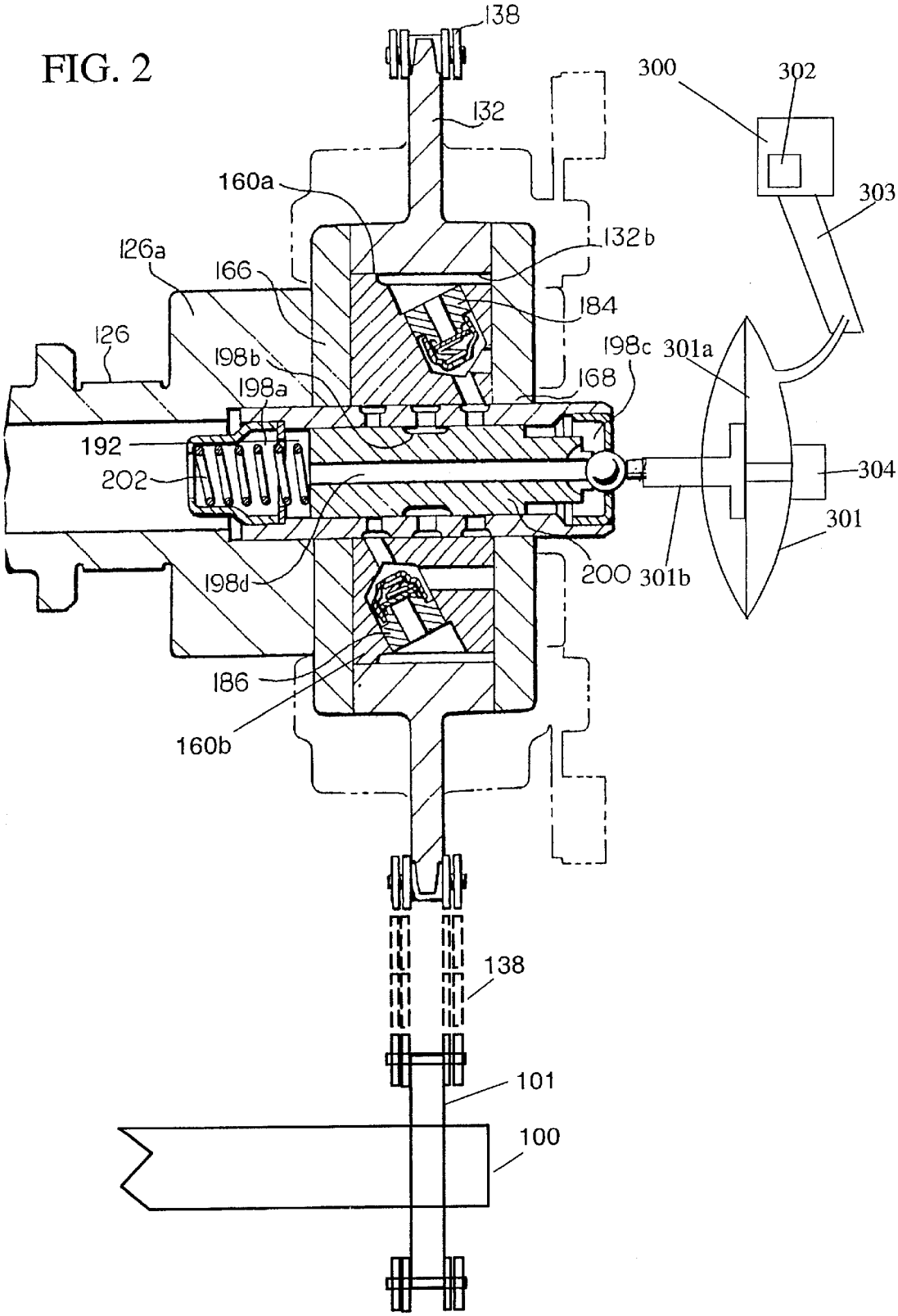
FIG. 2 is a sectional view of a cam phaser with an externally mounted vacuum controlled actuator and position sensor of the invention.

The position of spool (200) within member (198) is controlled by a vacuum controlled actuator (301). The vacuum controlled actuator (301) includes a diaphragm **(301*a*) and an actuator rod (301*b*). The diaphragm (301*a*) is any material which responds to vacuum pressure. For example, the diaphragm (301*a*) could be made of a rubber or other bendable material (FIG. 2). Alternatively, if the diaphragm (301*a*) is made of a metal, such as aluminum, the diaphragm (301*a*) preferably has concentric rings so it can bend (FIG. 1**).

In a preferred embodiment, a vacuum control valve (300) is connected to the actuator (301) via a connector (303). The vacuum control valve (300) modulates the amount of vacuum pressure which is applied to the actuator (301). The amount the valve (300) is open determines how much vacuum goes into the actuator (301). In a preferred embodiment, a variable force solenoid or a pulse width modulated solenoid (302) controls the movement of the valve (300). Alternatively, a motor within the valve (300) modulates the vacuum going to the actuator (301). In another alternative embodiment, the actuator (301) is pulse width modulated within the actuator (301) itself. Although a valve (300) is shown in the figures, any control system known in the art which modulates the amount of vacuum entering the actuator (301) is contemplated by the spirit of the present invention.

If the vacuum pressure is sucked out, the diaphragm (301*a*) moves back, and when more air is blown in, the diaphragm (301*a*) moves forward. As the diaphragm (301*a*) moves, the actuator rod (301*b*) also moves in response. The actuator rod (301*b*) is in contact with the extension of spool (200). This contact controls the movement of the spool (200). Actuator rod (301*b*) bears against the extension of vented spool (200), thus moving vented spool (200) to the right, as oriented in FIG. 1. If the force of spring (202) is in balance with the force exerted by actuator rod (301*b*) in the opposite direction, spool (200) will remain in its null or centered position. Thus, vented spool (200) can be moved in either direction by increasing or decreasing the amount of vacuum provided to actuator (301).

Engine control unit ("ECU") (1) monitors various engine parameters. The ECU receives signals from sensors corresponding to camshaft and crankshaft positions and utilizes this information to calculate a relative phase angle. A closed-loop feedback system which corrects for any phase angle error is preferably employed.

Figure 3:
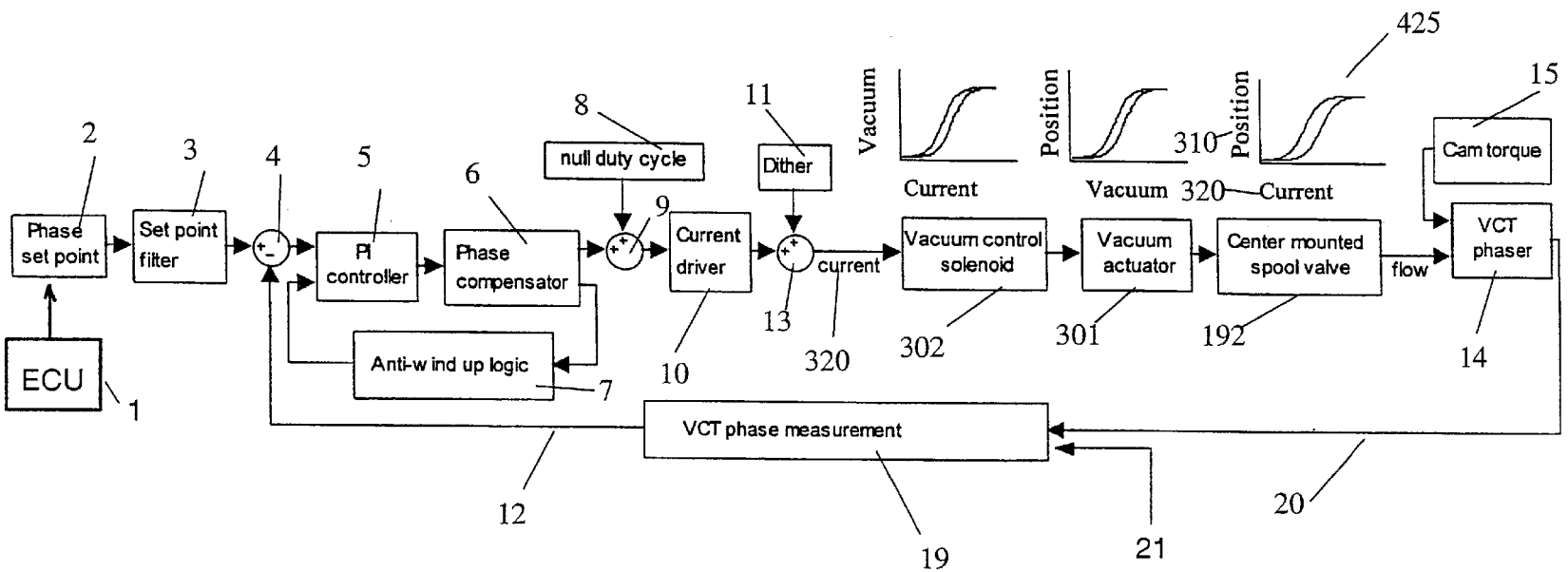
FIG. 3 is a block diagram of a cam torque actuated variable cam timing device with a vacuum controlled spool valve in an embodiment of the present invention.

FIG. 3 shows a block diagram of the control system shown of the present invention. The Engine Control Unit (ECU) (1) decides on a phase set point (2), based on various demands on the engine and system parameters (temperature, throttle position, oil pressure, engine speed, etc.). The set point is filtered (3) and combined (4) with a VCT phase measurement (12) in a control loop with a PI controller (5), phase compensator (6), and anti-windup logic (7). The output of this loop is combined (9) with a null duty cycle signal (8) into a current driver (10), whose output is combined (13) with a dither signal (11) to provide current (320) to drive the vacuum control solenoid (302). The vacuum control solenoid (302) provides vacuum pressure to the vacuum actuator (301). The actuator rod (301*b*) of the vacuum actuator (301) pushes upon the spool valve (192), which is located in the center of the phaser (14). The spool valve (192), in turn, controls fluid (engine oil) to activate the VCT phaser (14), either by applying oil pressure to the vane chambers or by switching passages to allow cam torque pulses (15) to move the phaser (14). The cam position is sensed by a cam sensor (20), and the crank position (or the position of the phaser drive sprocket, which is connected to the crankshaft) is also sensed by sensor (21), and the difference between the two is used by a VCT phase measurement circuit (19) to derive a VCT phase signal (12), which is fed back to complete the loop.

Figure 4:
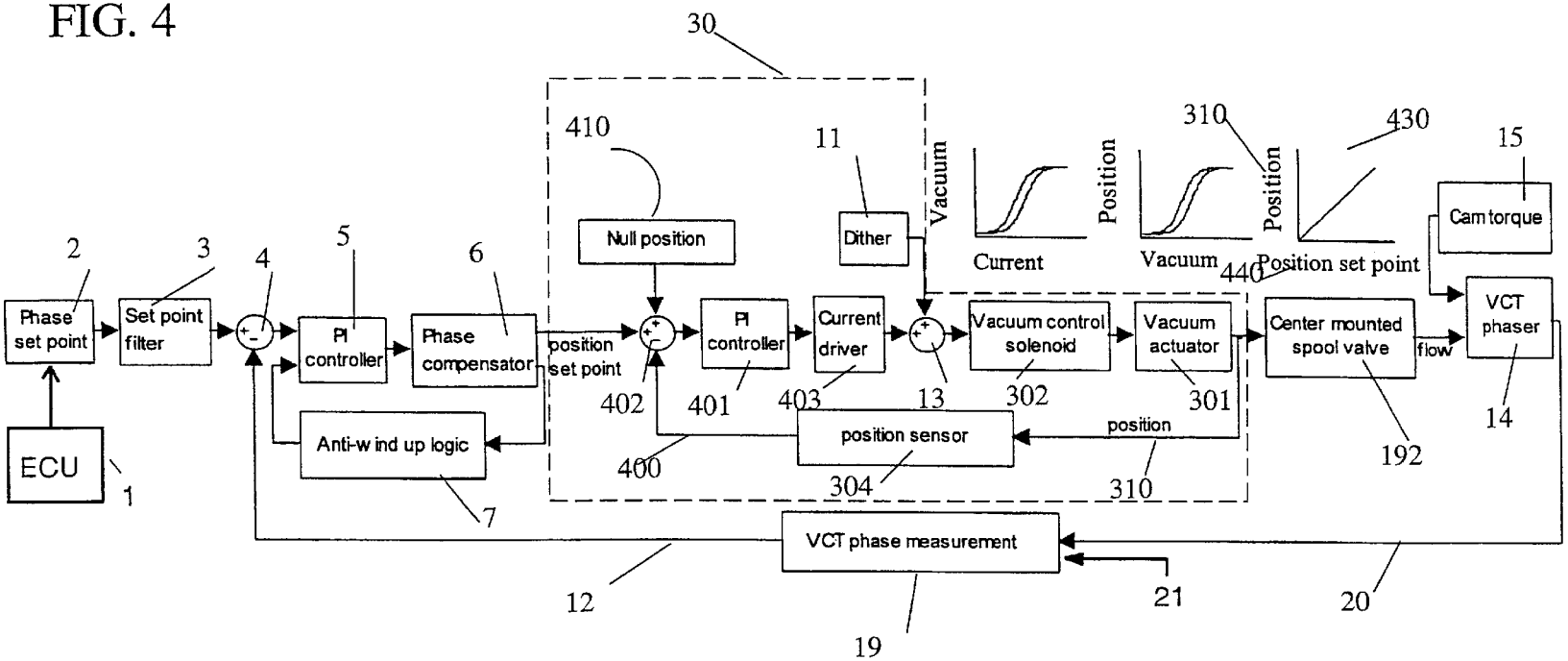
FIG. 4 is a block diagram of a cam torque actuated variable cam timing device with a vacuum controlled spool valve and spool valve position feedback in an alternative embodiment of the present invention

An alternative embodiment of the present invention is shown in FIGS. 2 and 4. A position sensor (304) mounted to the actuator rod (301*b*) controls the position of the center mounted spool valve (192). Although the position sensor (304) physically contacts the actuator rod (301*b*) in the figure, physical contact is not necessary. For example, the position sensor (304) could be optically, capacitively or magnetically coupled to the actuator (301). Position sensors (304) which could be utilized in this invention include, but are not limited to, linear potentiometers, hall effect sensors, and tape end sensors.

FIG. 4 shows a block diagram of a control circuit of the invention, which uses a feedback loop to control the position of the spool valve, and thereby reduce any frictional or magnetic hysteresis in the spool and solenoid control system. A second feedback loop controls the phaser angle. The inner loop (30) controls the spool valve position and the outer loop (similar to that shown in FIG. 3) controls the phase angle. An offset is preferably added to the spool valve position to move the spool valve to its steady state or null position. This null position is required so that the spool can move in to move the phaser in one direction and outward to move the phaser in the other direction.

The basic phaser control loop of FIG. 4 is the same as in FIG. 3, and where the figures are the same, the circuit will not be discussed separately. The difference between the embodiment shown in FIG. 4 and embodiment of FIG. 3 lies in the inner control loop (30), which starts with the output of phase compensator (6). The output of the compensator (6) is combined (402) with a null position offset (410) and the output (400) of the spool position sensor (304), and input to the PI controller (401) for the inner loop (30). The output of the PI controller (401) is input to a current driver (403), whose output is combined (13) with a dither signal (11), and the resulting current drives the vacuum control solenoid (302). The vacuum control solenoid (302) provides vacuum pressure to the vacuum actuator (301). The position of the vacuum actuator (301) is read by the position sensor (304), and the output (400) of the position sensor (304) is fed back to complete the loop (30).

In FIG. 3, the null position of the spool valve (192) varies, as the position (310) of the spool valve (192) with increasing current (320) is different than the position (310) of the spool valve (192) with decreasing current (320). This variable position is shown in graph (425). However, using position feedback eliminates this variability. After proceeding through the loop, the position (310) linearly increases with an increase in the position set point (440) as shown in graph (430). This type of system reduces any frictional or magnetic hysteresis in the spool (200) and actuator control system.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. In an internal combustion engine having a variable camshaft timing system for varying the phase angle of a camshaft relative to a crankshaft, a method of regulating the flow of fluid from a source to a means for transmitting rotary movement from the crankshaft to a housing, comprising the steps of:

sensing the positions of the camshaft and the crankshaft;

calculating a relative phase angle between the camshaft and the crankshaft, the calculating step using an engine control unit for processing information obtained from the sensing step, the engine control unit further adjusting a command signal based on a phase angle error;

controlling a position of a vented spool slidably positioned within a spool valve body, the controlling step utilizing a vacuum actuator coupled to the spool to vary the position of the vented spool;

supplying fluid from the source through the spool valve to a means for transmitting rotary movement to the camshaft, the spool valve selectively allowing and blocking flow of fluid through an inlet line and through return lines; and transmitting rotary movement to the camshaft in such a manner as to vary the phase angle of the camshaft with respect to the crankshaft, the rotary movement being transmitted through a housing, the housing being mounted on the camshaft, the housing further being rotatable with the camshaft and being oscillatable with respect to the camshaft.

2. The method of claim 1, wherein the step of controlling the position of the vented spool further utilizes a position sensor coupled to the vacuum actuator, wherein the position sensor senses a position of the spool.

3. The method of claim 2, wherein the position sensor is selected from the group consisting of a linear potentiometer, a hall effect sensor, and a tape end sensor.

4. The method according to claim 2, wherein the command signal adjusted by the engine control unit is selected from the group consisting of duty cycle and current.

5. An internal combustion engine, comprising:

a) a crankshaft;

b) at least one camshaft (126);

c) a cam drive connected to the crankshaft;

d) a variable cam phaser having an inner portion mounted to at least one camshaft and a concentric outer portion connected to the cam drive, the relative angular positions of the inner portion and the outer portion being controllable in response to a fluid control input, such that the relative phase of the crankshaft and at least one camshaft can be shifted by varying the fluid at the fluid control input of the variable cam phaser; and e) a variable cam timing system comprising:

i) a spool valve (192) comprising a spool slidably mounted in a bore at an axis at a center of the inner portion of the variable cam phaser, the bore having a plurality of passages coupled to the fluid control input of the variable cam phaser, such that axial movement of the spool in the bore controls fluid flow at the fluid control input of the variable cam phaser;

ii) a vacuum actuator (301) comprising a diaphragm (301*a*), an actuator rod (301*b*) coupled to the diaphragm and the spool, and a vacuum input such that a vacuum level at the vacuum input causes movement of the actuator rod, causing the spool to move axially in the bore; and iii) a vacuum control valve (300) connected to the vacuum input of the actuator such that the vacuum control valve (300) modulates an amount of vacuum pressure applied to the vacuum actuator.

6. The engine of claim 5, wherein the variable cam timing system further comprises:

iv) VCT phase measurement sensors (20)(21) coupled to the crankshaft and the at least one camshaft controlled by the variable cam timing system; and v) a VCT control circuit comprising:

a cam phase input coupled to the VCT phase measurement sensors;

a phase set point input for accepting a signal representing a desired relative phase of the camshaft and crankshaft;

a combiner (8) comprising a first input coupled to a null duty cycle signal (9), a second input coupled to an output of a phase comparator; and an output;

a current driver (10) having an input coupled to the output of the combiner, and an output;

a solenoid drive input coupled to the combiner output;

a solenoid drive output coupled to the electrical input of the vacuum control valve;

a signal processing circuit accepting signals from the phase set point input, cam phase input, and solenoid drive input and outputting to the solenoid drive output such that when a phase set point signal is applied at the phase set point input, the control circuit provides the vacuum input to cause the vacuum actuator to move the spool to control the variable cam phaser to shift the phase of the camshaft as selected by the phase set point signal.

7. The engine of claim 5, further comprising a position sensor (304) coupled to the actuator rod (301*b*), having a position signal output representing the physical position of the actuator rod (301*b*).

8. The engine of claim 7, wherein the variable cam timing system further comprises:

iv) VCT phase measurement sensors (20)(21) coupled to the crankshaft and the at least one camshaft controlled by the variable cam timing system; and v) a VCT control circuit comprising:

a cam phase input coupled to the VCT phase measurement sensors;

a phase set point input for accepting a signal representing a desired relative phase of the camshaft and crankshaft;

a vacuum actuator position input coupled to the position signal output; and a solenoid drive output coupled to the electrical input of a vacuum control valve;

a signal processing circuit accepting signals from the phase set point input, cam phase input, and vacuum actuator position input and outputting to the solenoid drive output such that when a phase set point signal is applied at the phase set point input, the control circuit provides the vacuum input to cause the vacuum actuator to move the spool to control the variable cam phaser to shift the phase of the camshaft as selected by the phase set point signal.

9. The engine of claim 8, in which the signal processing circuit comprises:

an outer loop for controlling the phase angle, coupled to the set point input, cam phase input, and solenoid drive output; and an inner loop for controlling the spool valve position, coupled to the vacuum actuator position input and to the inner loop;

such that the solenoid drive output as set by the outer loop is modified by the inner loop based on the vacuum actuator position.

10. The engine of claim 9, in which:

a) the outer loop comprises:

i) an anti-windup loop comprising:

A) a first PI controller (5) having a first input coupled to the set point input; a second input coupled to the cam phase input; a third input and an output;

B) a phase compensator (6) having an input coupled to the output of the first PI controller and a first output and a second output; and C) anti-windup logic (7) having an input coupled to the second output of the phase compensator and an output coupled to the third input of the PI controller;

ii) a combiner (402) having a first input coupled to a null position offset signal (410), a second input coupled to the output of the phase comparator, a third input, and an output;

iii) a second PI controller (401) having an input coupled to the output of the combiner and an output; and iv) a current driver (403) having an input coupled to the output of the second PI controller and an output coupled to the solenoid drive output; and b) the inner loop comprises coupling the vacuum actuator position input to the third input of the combiner.

11. The engine of claim 10, further comprising a dither signal (11) coupled to the solenoid drive output.

12. The engine of claim 7, wherein the position sensor is selected from the group consisting of a linear potentiometer, a hall effect sensor, and a tape end sensor.

13. The engine of claim 7, wherein a coupling between the actuator rod and the position sensor is selected from the group consisting of a physical coupling, an optical coupling, a magnetic coupling, and a capacitive coupling.

14. A variable cam timing system for an internal combustion engine having a crankshaft, at least one camshaft, a cam drive connected to the crankshaft, and a variable cam phaser having an inner portion mounted to at least one camshaft and a concentric outer portion connected to the cam drive, the relative angular positions of the inner portion and the outer portion being controllable in response to a fluid control input, such that the relative phase of the crankshaft and at least one camshaft can be shifted by varying the fluid at the fluid control input of the variable cam phaser, the variable cam timing system comprising:

a) a spool valve (192) comprising a spool slidably mounted in a bore at an axis at a center of the inner portion of the variable cam phaser, the bore having a plurality of passages coupled to the fluid control input of the variable cam phaser, such that axial movement of the spool in the bore controls fluid flow at the fluid control input of the variable cam phaser;

b) a vacuum actuator (301) comprising a diaphragm (301*a*), an actuator rod (301*b*) coupled to the diaphragm and the spool, and a vacuum input such that a vacuum level at the vacuum input causes movement of the actuator rod, causing the spool to move axially in the bore; and c) a vacuum control valve (300) connected to the vacuum input of the actuator such that the vacuum control valve (300) modulates an amount of vacuum pressure applied to the vacuum actuator.

15. The variable cam timing system of claim 14, further comprising:

d) VCT phase measurement sensors (20)(21) coupled to the crankshaft and the at least one camshaft controlled by the variable cam timing system; and e) a VCT control circuit comprising:

a cam phase input coupled to the VCT phase measurement sensors;

a phase set point input for accepting a signal representing a desired relative phase of the camshaft and crankshaft;

a combiner (8) comprising a first input coupled to a null duty cycle signal (9), a second input coupled to an output of a phase comparator; and an output;

a current driver (10) having an input coupled to the output of the combiner, and an output;

a solenoid drive input coupled to the combiner output;

a solenoid drive output coupled to the electrical input of the vacuum control valve;

a signal processing circuit accepting signals from the phase set point input, cam phase input, and solenoid drive input and outputting to the solenoid drive output such that when a phase set point signal is applied at the phase set point input, the control circuit provides the vacuum input to cause the vacuum actuator to move the spool to control the variable cam phaser to shift the phase of the camshaft as selected by the phase set point signal.

16. The variable cam timing system of claim 14, further comprising a position sensor (304) coupled to the actuator rod (301*b*), having a position signal output representing the physical position of the actuator rod (301*b*).

17. The variable timing system of claim 16, further comprising:

d) VCT phase measurement sensors (20)(21) coupled to the crankshaft and the at least one camshaft controlled by the variable cam timing system; and e) a VCT control circuit comprising:

a cam phase input coupled to the VCT phase measurement sensors;

a phase set point input for accepting a signal representing a desired relative phase of the camshaft and crankshaft;

a vacuum actuator position input coupled to the position signal output; and a solenoid drive output coupled to the electrical input of a vacuum control valve;

a signal processing circuit accepting signals from the phase set point input, cam phase input, and vacuum actuator position input and outputting to the solenoid drive output such that when a phase set point signal is applied at the phase set point input, the the control circuit provides the vacuum input to cause the vacuum actuator to move the spool to control the variable cam phaser to shift the phase of the camshaft as selected by the phase set point signal.

18. The variable cam timing system of claim 17, in which the signal processing circuit comprises:

an outer loop for controlling the phase angle, coupled to the set point input, cam phase input, and solenoid drive output; and an inner loop for controlling the spool valve position, coupled to the vacuum actuator position input and to the inner loop;

such that the solenoid drive output as set by the outer loop is modified by the inner loop based on the vacuum actuator position.

19. The variable cam timing system of claim 18, in which:

a) the outer loop comprises:

i) an anti-windup loop comprising:

A) a first PI controller (5) having a first input coupled to the set point input; a second input coupled to the cam phase input; a third input and an output;

B) a phase compensator (6) having an input coupled to the output of the first PI controller and a first output and a second output; and C) anti-windup logic (7) having an input coupled to the second output of the phase compensator and an output coupled to the third input of the PI controller;

ii) a combiner (402) having a first input coupled to a null position offset signal (410), a second input coupled to the output of the phase comparator, a third input, and an output;

iii) a second PI controller (401) having an input coupled to the output of the combiner and an output; and iv) a current driver (403) having an input coupled to the output of the second PI controller and an output coupled to the solenoid drive output; and b) the inner loop comprises coupling the vacuum actuator position input to the third input of the combiner.

20. The variable cam timing system of claim 19, further comprising a dither signal (11) coupled to the solenoid drive output.

21. The variable cam timing system of claim 16, wherein the position sensor is selected from the group consisting of a linear potentiometer, a hall effect sensor, and a tape end sensor.

22. The variable cam timing system of claim 16, wherein a coupling between the actuator rod and the position sensor is selected from the group consisting of a physical coupling, an optical coupling, a magnetic coupling, and a capacitive coupling.

* * * * *

UNITED STATES PATENT AND TRADEMARK OFFICE

CERTIFICATE OF CORRECTION

PATENT NO. : 6,729,283 B2
DATED : May 4, 2004
INVENTOR(S) : Simpson et al.

It is certified that error appears in the above-identified patent and that said Letters Patent is hereby corrected as shown below:

Title page, Item [54], and Column 1, lines 1-5,
Should read:
-- EXTERNALLY MOUNTED VACUUM CONTROLLED ACTUATOR WITH POSITION SENSOR CONTROL MEANS TO REDUCE FRICTIONAL AND MAGNETIC HYSTERESIS --

Signed and Sealed this

Third Day of August, 2004

JON W. DUDAS
*Acting Director of the United States Patent and Trademark Office*